US005855057A

United States Patent [19]

Anscher

[11] Patent Number: 5,855,057

[45] Date of Patent: Jan. 5, 1999

[54] BUCKLE ASSEMBLY

[75] Inventor: Joseph Anscher, Muttontown, N.Y.

[73] Assignee: National Molding Corp., Farmingdale, N.Y.

[21] Appl. No.: 999,109

[22] Filed: Dec. 29, 1997

[51] Int. Cl.[6] ..... A44B 11/26

[52] U.S. Cl. ..... 24/614; 24/625; 24/615

[58] Field of Search ..... 24/614, 615, 625, 24/633, 632, 573, 324, 323, 618, 616

[56] References Cited

U.S. PATENT DOCUMENTS

| | | | |
|---|---|---|---|
| 4,679,282 | 7/1987 | Feng | 24/614 |
| 4,793,032 | 12/1988 | Crowle | 24/615 |
| 4,802,262 | 2/1989 | Kasai . | |
| 4,864,700 | 9/1989 | Kasai . | |
| 4,866,819 | 9/1989 | Kasai . | |
| 4,928,364 | 5/1990 | Ikeda | 24/614 |
| 4,977,650 | 12/1990 | Ida | 24/614 |
| 4,999,886 | 3/1991 | Kasai . | |
| 5,113,556 | 5/1992 | Murai et al. | 24/614 X |
| 5,440,792 | 8/1995 | Ida | 24/625 X |
| 5,709,014 | 1/1998 | Takahashi | 24/614 |

*Primary Examiner*—Anthony Knight
*Assistant Examiner*—Robert J. Sandy
*Attorney, Agent, or Firm*—Collard & Roe, P.C.

[57] ABSTRACT

A plug and socket-type buckle assembly in which the plug portion comprises a base and a flexible plate integrally formed therewith. A locking lug extends across the free end of the plate and protrudes above and below the flat surfaces of the plate. The socket portion comprises a top part and a bottom part integrally formed therewith to define a cavity for receiving the plug portion. The top part has a flexible release button integrally formed therewith, with a downwardly projecting tip. There is at least one projecting ledge disposed on the inside surface of the top part for engaging one side of the locking lug when the plug portion is inserted in the socket portion. A flexible tongue is integrally formed with the bottom part and has means for engaging an opposite side of the locking lug when the plug portion is inserted in the socket portion. Downward pressure on the release button when the plug portion is inserted in the socket portion disengages the locking lug from the projecting ledge. Further pressure on the release button causes the tip of the release button to bend the flexible tongue and release the locking lug from the flexible tongue to remove the plug portion from the socket portion.

17 Claims, 8 Drawing Sheets

BUCKLE ASSEMBLY

BACKGROUND OF THE INVENTION

1. Field of the Invention

This invention relates to a novel buckle assembly. In particular, the invention relates to a plug and socket type buckle assembly for use on various articles such as luggage and clothing.

2. The Prior Art

Plug and socket type buckles are useful for connecting two ends of a strap together on various articles such as luggage and outerwear. These types of buckles have a plug member connected to one end of a strap and a socket member connected to an end of a second strap. The straps are connected by locking the plug into the socket. Typically these plug and socket type buckles have a way of easily releasing the plug from the socket, such as by a center push button on the socket.

One example of this type of device is shown in U.S. Pat. No. 4,866,819 to Kasai. In this device, the plug side of the buckle has a thin plate portion with two resilient locking legs. A locking lug is disposed on the underside of each locking leg. When the plug is inserted into the socket, the lugs on each locking leg engage a retaining surface in the socket member and lock the plug and socket together. A release button is located on the socket, which pushes the lugs free of the retaining surface to release the plug from the socket. Various other types of plug and socket type buckles are disclosed in U.S. Pat. Nos. 4,802,262, 4,999,886 and 4,864,700 all to Kasai.

These buckles enable the user to easily lock and unlock two straps together. However, they all suffer from the drawback of insufficient strength under high degrees of tension. Since the lugs are located on only one side of the locking legs, excessive angular pressure on the buckle from a strap being pulled can cause the buckle to inadvertently release.

Another drawback of the prior art devices is that they only lock when the pieces are in one particular orientation. Turning either the plug or the socket 180 degrees will prevent locking of the device. This feature can be inconvenient, especially if a user is rushed or is attempting to lock the buckle in unlit conditions.

SUMMARY OF THE INVENTION

It is therefore an object of the present invention to provide a plug and socket type buckle that does not inadvertently release even under high amounts of tension from all angles.

It is another object of the present invention to provide a plug and socket type buckle that can be locked in any orientation.

It is yet another object of the present invention to provide a plug and socket type buckle that is simple to lock and release.

These and other objects of the invention are accomplished by a plug and socket-type buckle assembly in which the plug portion comprises a base and a flexible plate integrally formed therewith. A locking lug extends across the free end of the plate and protrudes above and below the flat surfaces of the plate. The socket portion comprises a top part and a bottom part integrally molded together to define a cavity for receiving the plug portion. The top part has a integrally molded flexible release button with a downwardly projecting tip.

There is at least one projecting ledge disposed on the inside surface of the top part for engaging one side of the locking lug when the plug portion is inserted in the socket portion. A flexible tongue is integrally formed with the bottom part and has means for engaging an opposite side of the locking lug when the plug portion is inserted in the socket portion.

Downward pressure on the release button when the plug portion is inserted in the socket portion disengages the locking lug from the projecting ledge. Further pressure on the release button causes the tip of the release button to bend the flexible tongue and release the locking lug from the flexible tongue to remove the plug portion from the socket portion.

The flexible plate on the plug element is preferably bifurcated down the middle into two segments. Each segment has a locking lug extending across its free end. In this situation, the top part of the socket portion has two projecting ledges, with one projecting ledge contacting the locking lug on each segment of the flexible plate when the plug portion is inserted into the socket portion. The projecting ledges are disposed on either side of the release button.

The flexible tongue extends into the cavity between the top and bottom plate and forms two shoulders and a tip extending beyond the shoulders. The tip on the flexible tongue contacts the tip of the release button when the release button is depressed. Each shoulder engages the bottom side of one of the locking lugs on each segment of the flexible plate to lock the plug portion into the socket portion.

To add to the stability of the device, there are two guide arms extending out from the base on each side of the flexible plate. The guide arms are made of thicker material than the flexible plate and serve to guide the plug portion into the socket portion for easy locking of the two portions together.

Both the plug portion and socket portion are equipped with transverse bars or other means for securing the ends of a strap or belt to the buckle assembly. The plug and socket portions are each integrally molded in one piece. The buckle assembly can be manufactured from any suitable material, such as acetal, nylon or polypropylene. Other materials could also be envisioned.

In an alternative embodiment, the flexible plate is not bifurcated and extends out as a unified flat planar element. The locking lug extends across the entire tip of the flexible plate. Instead of the two projecting ledges disposed on either side of the release button as with the bifurcated plate, there is a single ledge disposed on the underside of the release button for engaging the top side of the locking lug.

In the alternative embodiment a ledge is formed on an intermediate portion of the flexible tongue and projects into the cavity. The ledge engages the locking lug on the flexible plate to secure the plug portion into the socket portion. A transverse bar is formed on the tip of the tongue and also projects into the cavity. When the release button is depressed, the tip of the release button contacts the transverse bar and moves the flexible tongue out of the cavity. This movement first releases the top of the locking lug from the projecting ledge on the release button, and then releases the bottom of the locking lug from the ledge on the tongue to thus release the plug portion from the socket portion.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENTS

Figure 1:
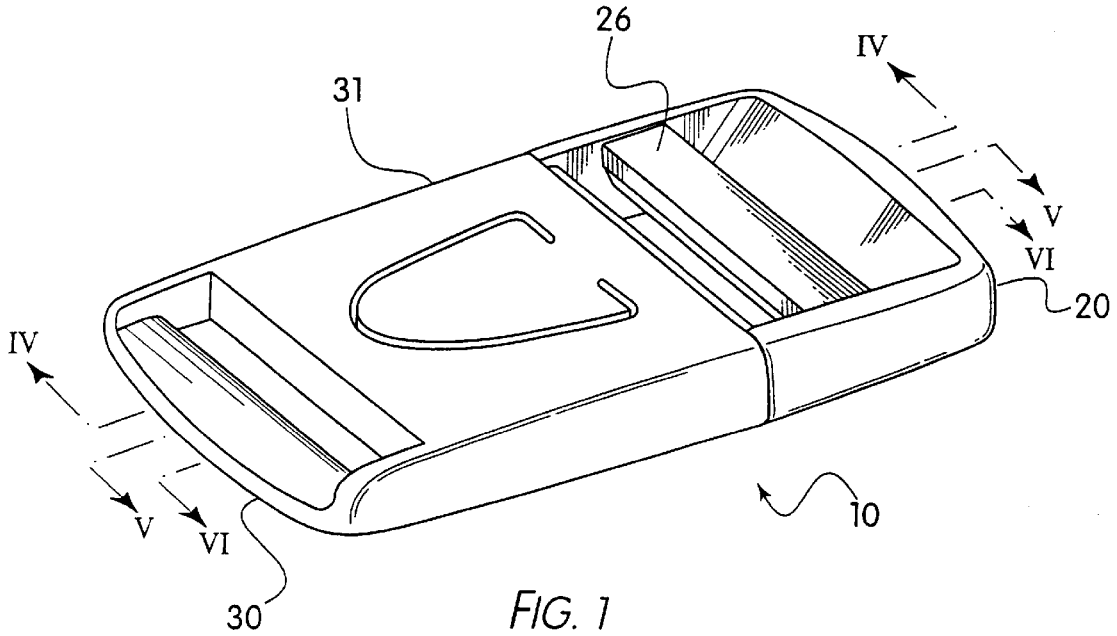
FIG. 1 is a perspective view of the buckle assembly according to the invention in an assembled state.
Figure 2:
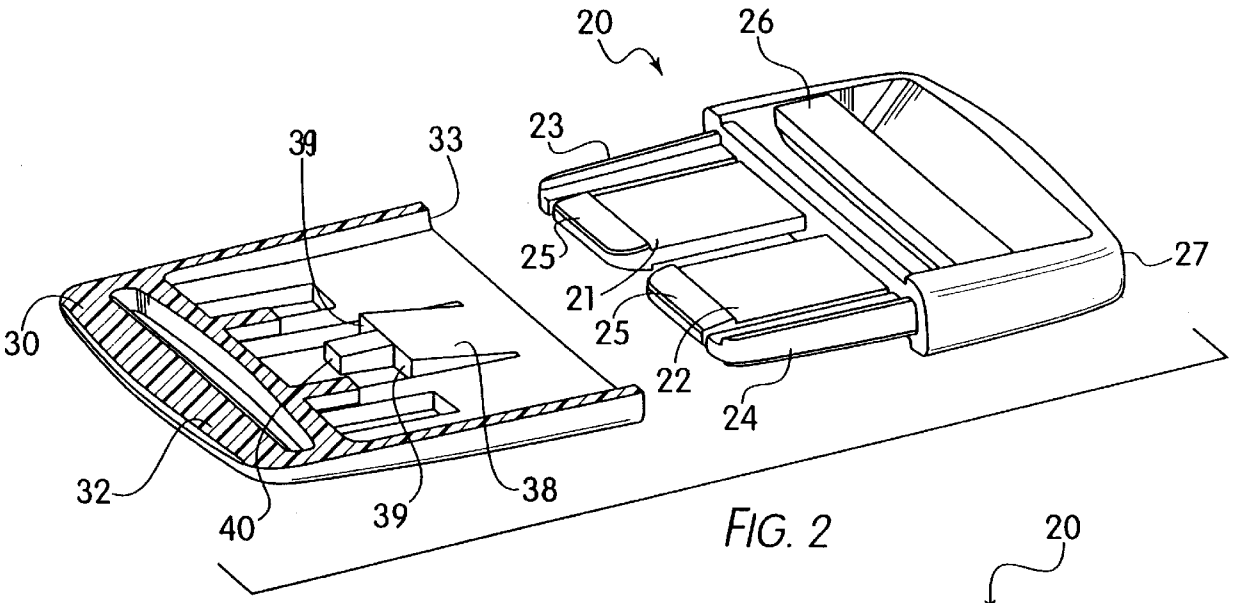
FIG. 2 is a top perspective view of a preferred embodiment of he buckle assembly in a disassembled state with the bottom part of the socket portion cut away.
Figure 3:
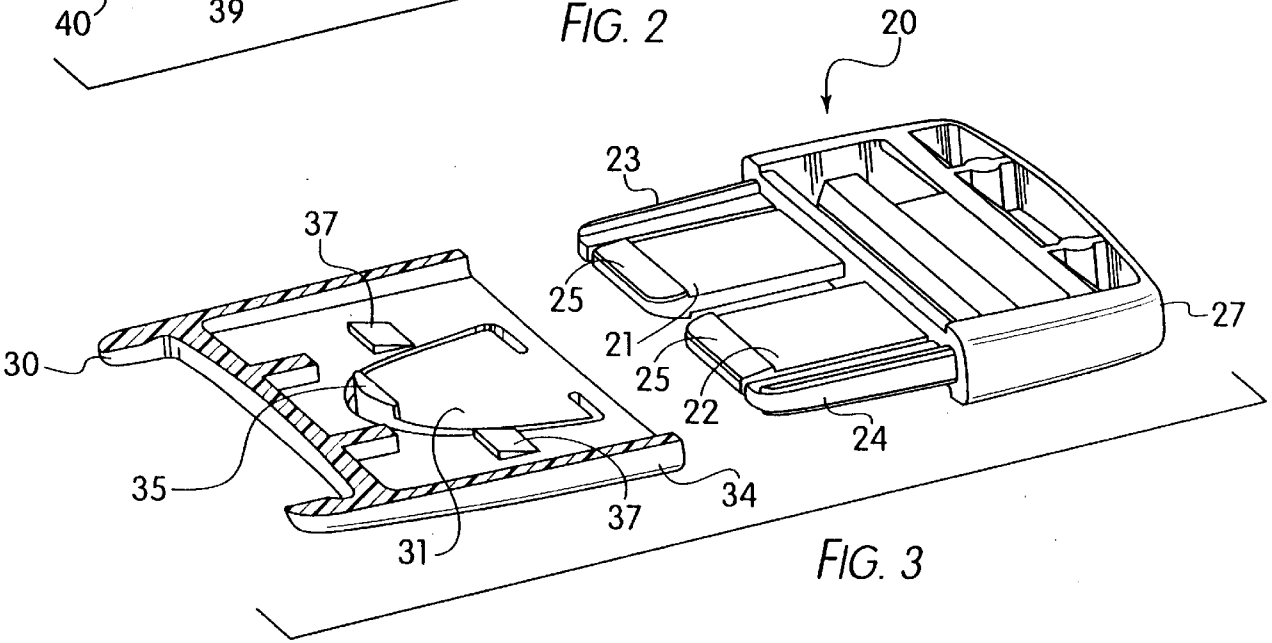
FIG. 3 is a bottom perspective view of the preferred embodiment of FIG. 2 with the top part cut away.

Referring now in detail to the drawings and in particular, FIGS. 1–3, there is shown a buckle assembly 10 according to the invention. Assembly 10 comprises plug portion 20 and socket portion 30. A release button 31 is integrally formed with the top surface of socket portion 30 to disengage plug portion 20 from socket portion 30.

Plug portion 20 has a bifurcated insertion plate consisting of two flexible sections 21 and 22 integrally formed with a base 27. Guide arms 23 and 24 extend along the sides of plug portion 20 parallel to sections 21 and 22. Guide arms 23 and 24 are thicker than sections 21 and 22. Guide arms 23 and 24 precisely align plug portion 20 within socket portion 30 to lock the two portions together.

Flexible sections 21 and 22 have a locking lug 25 extending transversely across their free ends. Locking lugs 25 extend above and below the flat planar sides of sections 21 and 22 to engage elements in socket portion 30. Plug portion 20 is also equipped with a transverse bar 26 to allow the end of a strap or belt to be attached to plug portion 20.

Socket portion 30 is comprised of a bottom part 33, shown in FIG. 2, integrally molded with a top part 34, shown in FIG. 3. Socket portion 30 is also equipped with a transverse bar 21 on its end for attachment of a strap or belt.

Top part 34 has a flexible release button 31 integrally formed therewith. Release button 31 has a downwardly-projecting tip 35. Two shoulder ledges 37 are arranged on either side of release button 31 and extend into the space between top part 34 and bottom part 33.

Bottom part 33 is equipped with a flexible tongue 38 integrally formed therewith. Flexible tongue 38 has two shoulders 39 and a tip 40 that extends into the space between top part 34 and bottom plate 33. When release button 31 is depressed, downwardly-projecting tip 35 contacts tip 40 and moves tongue 38 out of the space between the plates.

Figure 4:
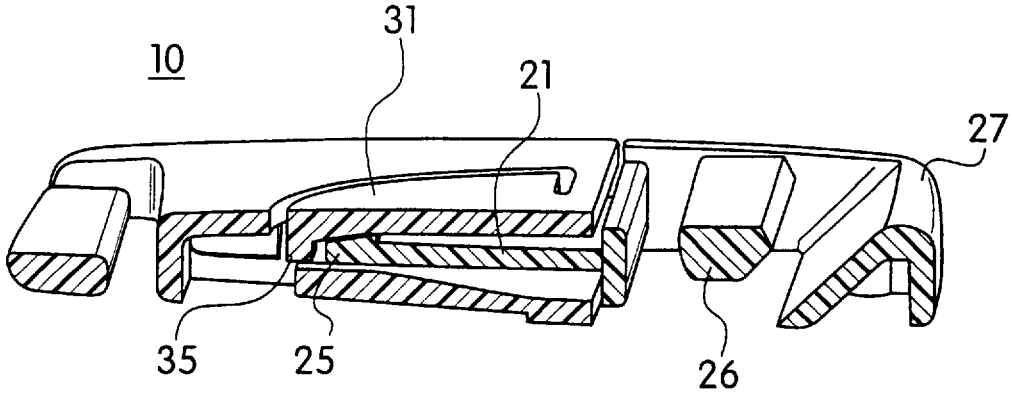
FIG. 4 is a cross-sectional view taken along lines IV—IV of FIG. 1.
Figure 5:
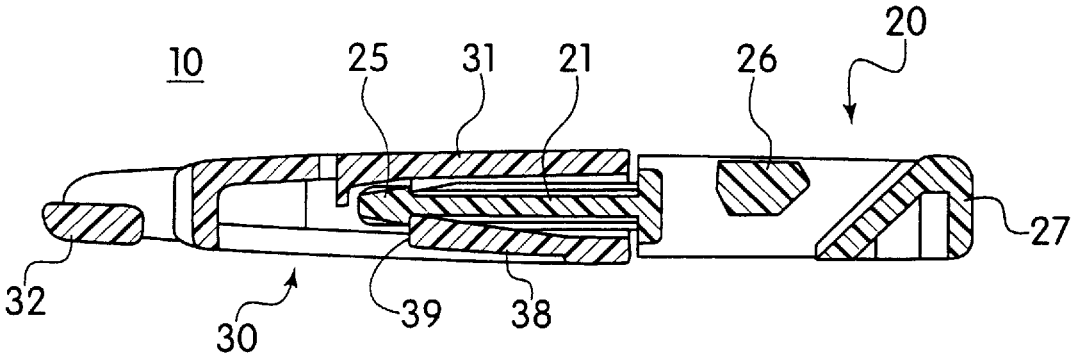
FIG. 5 is a cross-sectional view taken along lines V—V of FIG. 1.
Figure 6:
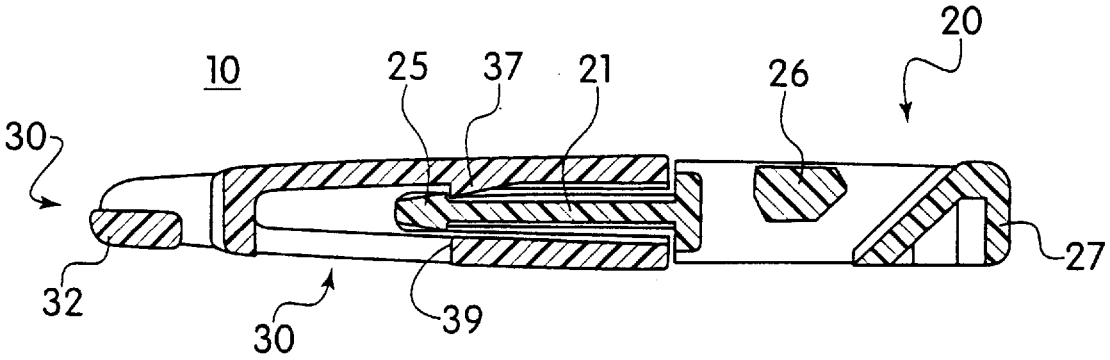
FIG. 6 is a cross-sectional view taken along lines VI—VI of FIG. 1.

FIGS. 4–6 show several cross-sectional views of buckle assembly 10 in its assembled position. As shown in FIG. 5, the bottom side of locking lug 25 is securely engaged by shoulder 39 on tongue 38, and as shown in FIG. 6, the top side of locking lug 25 is engaged by ledge 37 on top plate 34.

Figure 7A:
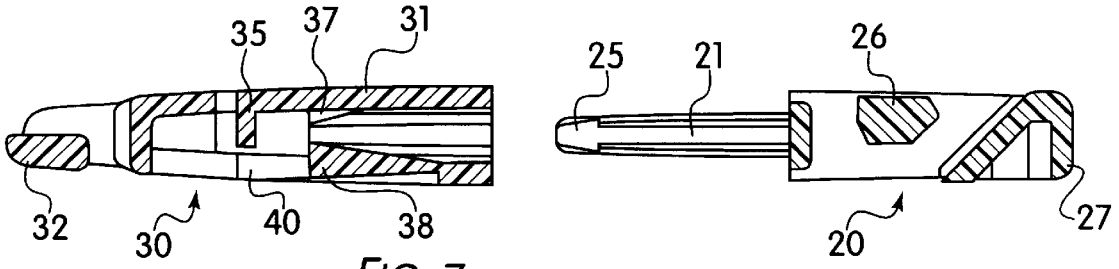
FIGS. 7A–7D show cross-sectional views of the plug portion being inserted and locked into the socket portion of the embodiment shown in FIG. 2.
Figure 7B:
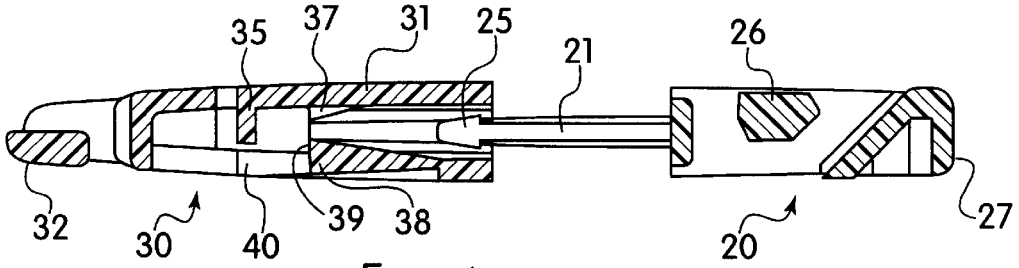
Figure 7C:
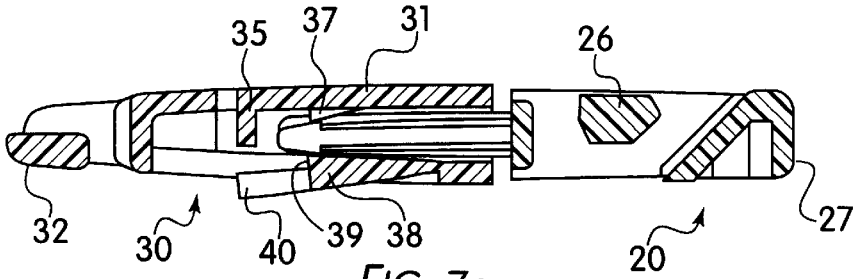
Figure 7D:
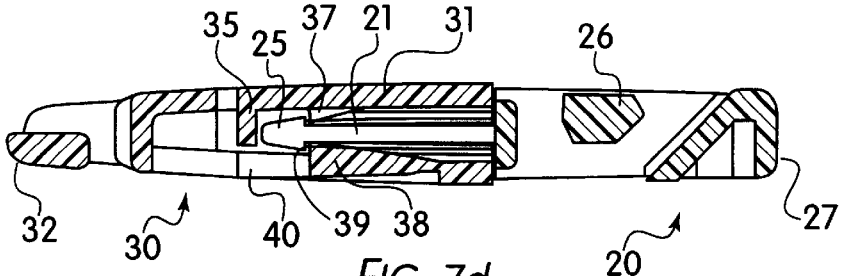

FIGS. 7A–7D are cross-sectional views showing the process of inserting and locking plug portion 20 into socket portion 30. As plug portion 20 is slid into the space between top part 34 and bottom part 33 of socket portion 30, locking lug 25 contacts ledge 37, presses against tongue 38 and forces tongue 38 out of the space, as shown in FIG. 7C.

Once locking lug 25 passes beyond shoulders 39 and ledge 37, tongue 38 snaps back into place and locks locking lug 25 on plate 21 into place. At this point, plug portion 20 is securely locked into socket portion 30. This lock is secure, even under torsional stresses from all angles, because locking lug 25 is locked from both its top surface and its bottom surface.

Figure 8A:
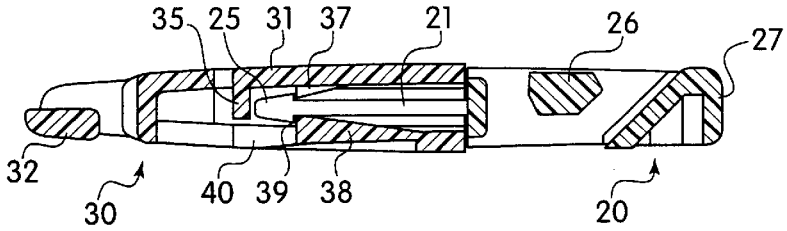
FIGS. 8A–8E show cross-sectional views of the plug portion being removed from the socket portion of the embodiment shown in FIG. 2.
Figure 8B:
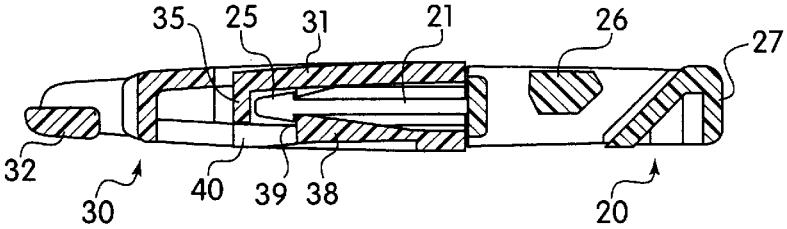
Figure 8C:
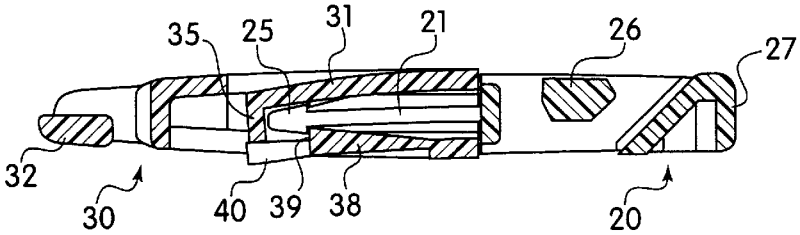
Figure 8D:
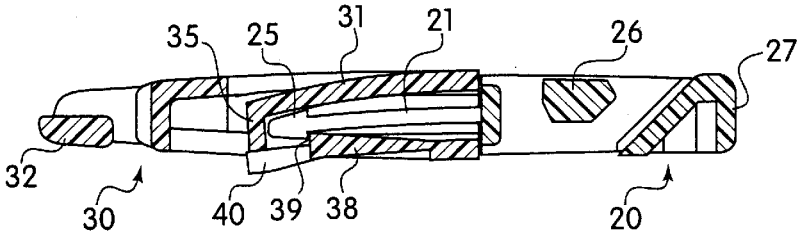
Figure 8E:
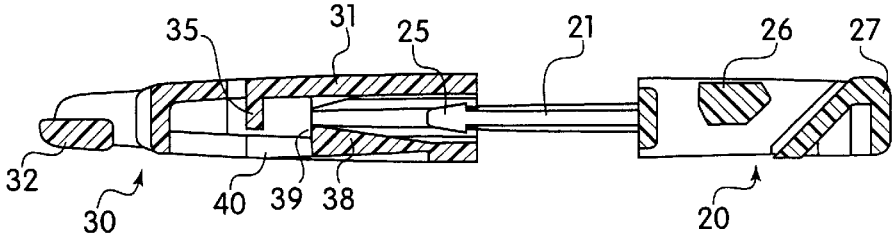

FIGS. 8A–8E illustrate the unlocking and removal of plug portion 20 from socket portion 30. To unlock buckle assembly 10, the user presses release button 31. As button 31 is depressed, it contacts the top side of locking lug 25 and forces lug 25 into a downward position until it clears ledges 37 on top plate 34, as shown in FIGS, 8B–8D. Continued pressing of button 31 causes the downwardly-projecting tip 35 of button 31 to contact tip 40 of tongue 38 and force tongue 38 downward. This downward movement releases the bottom of locking lug 25 from shoulders 39 and allows plug portion 20 to slide out of socket portion 30, as shown in FIG. 8E.

The configuration of locking lug 25 in combination with the ledges on top part 34 and the shoulders on tongue 38 allow plug portion 20 to be easily locked into and unlocked from socket portion 30. The lock is extremely stable, because locking lug 25 is locked from both the top and the bottom. In addition, the symmetrical shape of locking lug 25 allows plug portion 20 to be locked into socket portion 30 in any orientation.

Figure 9:
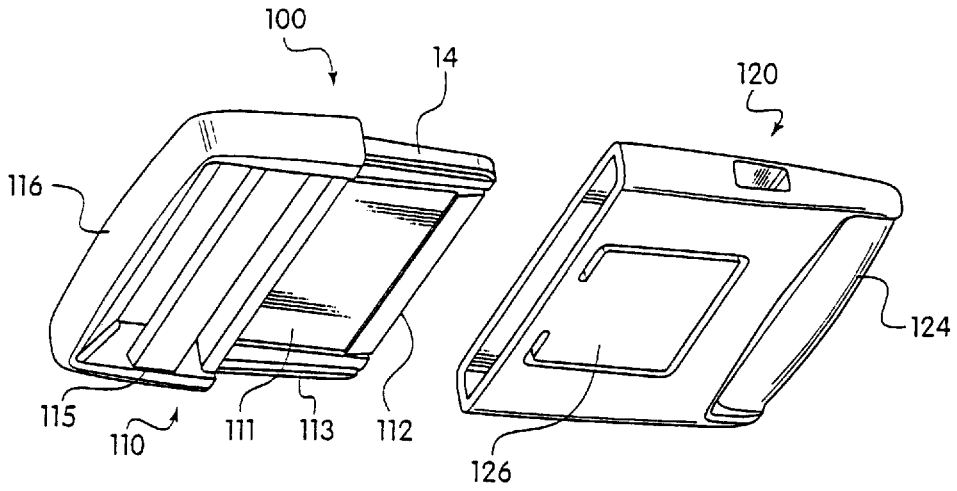
FIG. 9 shows a bottom perspective view of an alternative embodiment of the invention.
Figure 10:
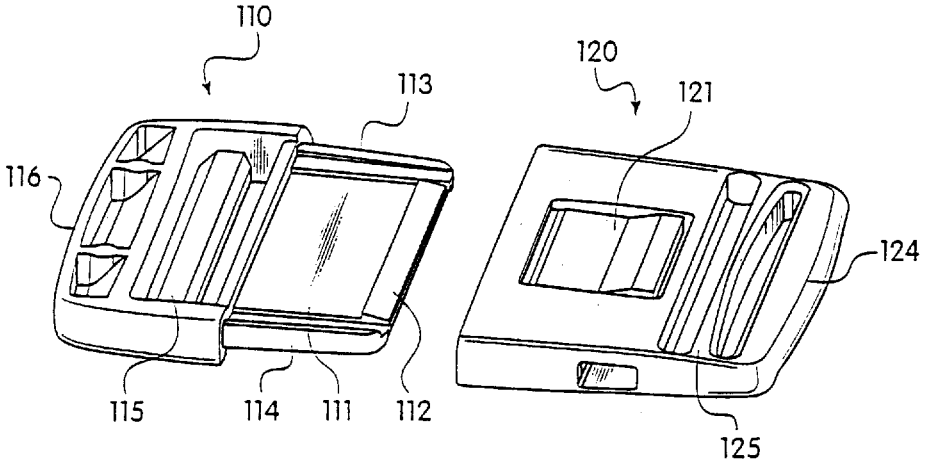
FIG. 10 shoes a top view of the embodiment shown in FIG. 9.

A second embodiment of the buckle assembly according to the invention is shown in FIGS. 9 and 10. In this embodiment, buckle assembly 100 is comprised of plug portion 110 and socket portion 120. In plug portion 110, there is a flexible plate 111 integrally molded with a base 116. In contrast to the embodiment shown in FIGS. 1–8, flexible plate 111 is not bifurcated. Locking lug 112 extends across the free end of plate 111 and protrudes above and below the planar surfaces of plate 111. Two guide arms 113 and 114 extend along the sides of plate 111 and help to guide plate 111 precisely into socket 120. A transverse bar 115 is molded to base 116 and allows for the end of a strap or belt to be attached to plug portion 111.

Figure 11:
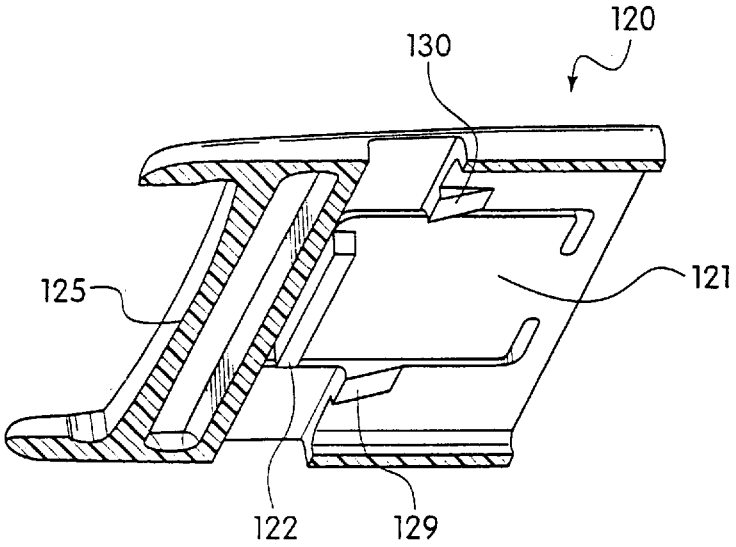
FIG. 11 shows a perspective view of the top part of the socket portion of the embodiment shown in FIG. 9.
Figure 12:
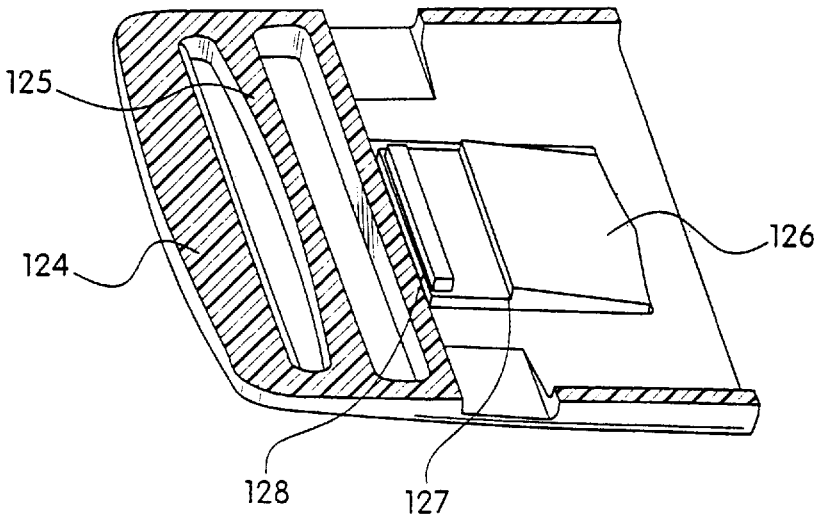
FIG. 12 shows a perspective view of the bottom part of the socket portion of the embodiment shown in FIG. 10.
Figure 13A:
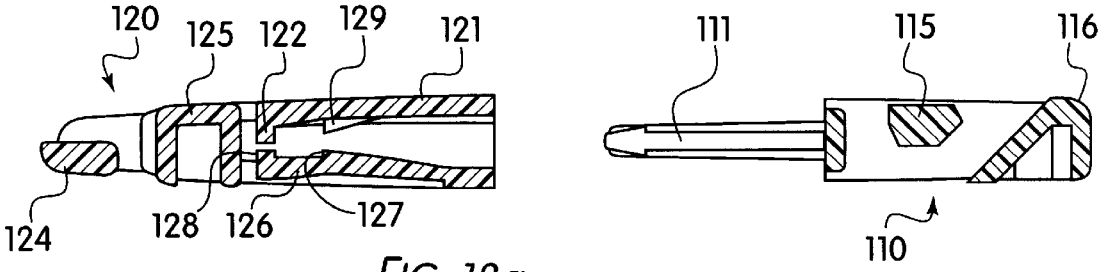
FIGS. 13A–13D show cross-sectional views of the plug portion being inserted and locked into the socket portion of the embodiment shown in FIG. 9.
Figure 13B:
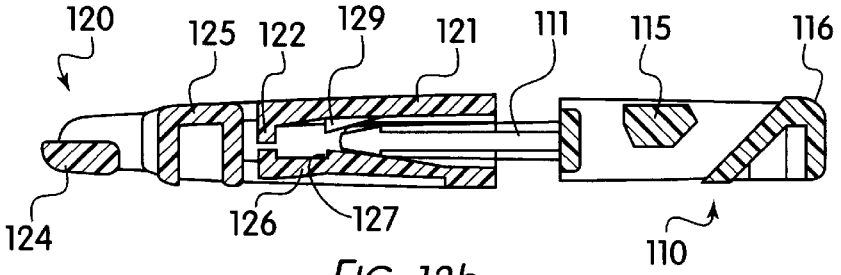
Figure 13C:
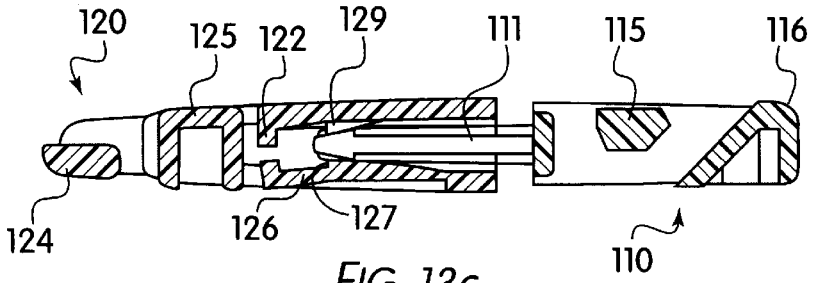
Figure 13D:
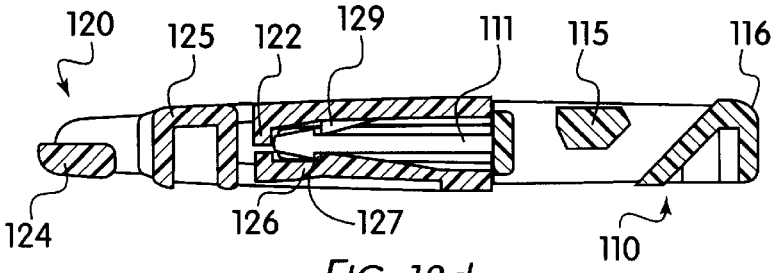

Socket portion 120 also has a transverse bar 125 integrally molded therewith for the attachment of the end of a strap or belt. A release button 121 is integrally formed with the top surface of socket portion 120. As shown in FIG. 11, release button 121 has a downwardly protruding end 122. Two downwardly-protruding ledges 129 and 130 are formed with the underside of the top of socket portion 120, on either side of release button 121.

An upwardly-protruding flexible tongue 126 is integrally formed with the bottom side of socket portion 120. Tongue 126 has an integrally formed transverse ledge 127 located at an intermediate section of tongue 126. The free edge of tongue 126 has a transverse arm 128 that protrudes upward into the cavity of socket portion 120. Transverse arm 128 is positioned to contact the downwardly protruding end 122 of release button 121 when release button 121 is pressed downward.

Insertion of plug portion 110 into socket portion 120 is shown in FIGS. 13A–13D. This proceeds in a similar manner to that shown in FIGS. 7A–7D. As flexible plate 111 is inserted into socket portion 120, locking lug 112 slides past ledge 129 and over ledge 127 on tongue 126. At this point, locking lug 112 is securely held within socket portion 120 between ledges 127 and 129. Releasing flexible plate 111 from socket portion 120 proceeds in a manner similar to that shown in FIGS. 8A–8E with respect to the first embodiment. To release flexible plate 111, release button 121 is depressed, which releases locking lug 112 first from ledges 129 and 130, and then from ledge 127 as tongue 126 is depressed by release button 121 as well. This embodiment has the same advantages as the first embodiment, i.e., it is stable under tension from all angles and can be locked in any orientation.

Accordingly, while only two embodiments of the present invention have been shown and described, it is obvious that many changes and modifications may be made thereunto without departing from the spirit and scope of the invention.

What is claimed is:

1. A buckle assembly comprising:

(a) a plug portion comprising:

(i) a base;

(ii) a flexible plate integrally formed with said base and having two flat surfaces and a free end;

(iii) a locking lug extending across said free end and having two sides that protrude beyond the flat surfaces of the plate; and (b) a socket portion adapted for coupling to said plug portion, comprising:

(i) a top part having an outside surface and an inside surface;

(ii) a flexible release button integrally formed with said top part and having a downwardly projecting tip;

(iii) at least one projecting ledge disposed on the inside surface of said top part for engaging one side of said locking lug when said plug portion is inserted in said socket portion;

(iv) a bottom part integrally formed with said top part and having an outside surface and an inside surface said top and bottom parts defining a cavity for insertion of said plug portion; and (v) a flexible tongue integrally formed with said bottom part, said tongue having means for engaging an opposite side of said locking lug when said plug portion is inserted in said socket portion, wherein downward pressure on said release button when said plug portion is inserted in said socket portion disengages said locking lug from said projecting ledge, and further downward pressure on said release button bends the flexible tongue and releases the locking lug from the flexible tongue to remove said plug portion from said socket portion.

2. The buckle assembly according to claim 1, wherein said flexible plate is bifurcated into two segments.

3. The buckle assembly according to claim 2, wherein there are two projecting ledges, one of said projecting ledges contacting the locking lug on each segment of said flexible plate.

4. The buckle assembly according to claim 2, wherein said flexible tongue extends into the cavity and forms two shoulders and a tip extending beyond said shoulders for contacting the tip of the release button, said shoulders forming the means for engaging an opposite side of the locking lug.

5. The buckle assembly according to claim 1, wherein the means for engaging an opposite side of the locking lug comprises a transverse ledge projecting into the cavity at an intermediate portion of said tongue, and further comprising a transverse arm at the tip of said tongue, said transverse bar projecting into the cavity and contacting the tip of said release button when said release button is depressed.

6. The buckle assembly according to claim 5, wherein the transverse ledge is integrally formed with the release button and extends across an intermediate portion thereof.

7. The buckle assembly according to claim 1, further comprising two guide arms extending out from the base on each side of said flexible plate, said guide arms guiding said plug portion into said socket portion.

8. The buckle assembly according to claim 1, further comprising means on said plug portion and on said socket portion for attaching said plug portion and said socket portion to straps.

9. The buckle assembly according to claim 1, wherein said plug portion is integrally molded in one piece and said socket portion is integrally molded in one piece.

10. A socket device for receiving a plug having a flexible plate with a locking lug in a plug and socket type buckle assembly, comprising:

a top part having an outside surface and an inside surface;

a flexible release button integrally formed with said top part and having a downwardly projecting tip;

at least one projecting ledge disposed on the inside surface of said top part for engaging one side of the locking lug when the plug is inserted in said socket device;

a bottom part integrally formed with said top part and having an outside surface and an inside surface, said top and bottom parts defining a cavity for insertion of said plug; and a flexible tongue integrally formed with said bottom plate, said tongue having means for engaging an opposite side of the locking lug when the plug is inserted in said socket device, wherein downward pressure on said release button when said plug is inserted in said socket device disengages the locking lug from said projecting ledge, and further downward pressure on said release button bends the flexible tongue and releases the locking lug from the flexible tongue to remove said plug from said socket device.

11. The socket device according to claim 10, wherein the flexible plate on the plug is bifurcated into two segments and wherein there are two projecting ledges, one of said projecting ledges contacting the locking lug on each of segment of said flexible plate.

12. The socket device according to claim 11, wherein said flexible tongue extends into the cavity and forms two shoulders and a tip extending beyond said shoulders for contacting the tip of the release button, said shoulders forming the means for engaging an opposite side of the locking lug.

13. The socket device according to claim 10, wherein the means for engaging an opposite side of the locking lug comprises a transverse ledge projecting into the cavity at an intermediate portion of said tongue, and further comprising a transverse bar at the tip of said tongue, said second transverse bar projecting into the cavity and contacting the tip of said release button when said release button is depressed.

14. The socket device according to claim 13, wherein the transverse ledge is integrally formed with the release button and extends across an intermediate portion thereof.

15. A plug device for inserting into a socket in a plug and socket type buckle assembly, comprising:

a base;

a flexible plate integrally formed with said base and having two flat surfaces and a free end; and a locking lug extending across said free end and having two sides that protrude above and below the flat surfaces of the plate, each side forming an abutting portion protruding out from the flat surface of the plate, each abutting portion for locking the plug into a socket assembly from both surfaces of the plate.

16. The plug device according to claim 15, wherein said flexible plate is bifurcated into two segments.

17. The plug device according to claim 15, further comprising two guide arms extending out from the base on each side of said flexible plate, said guide arms guiding said plug into said socket.

* * * * *